US010968736B2

(12) United States Patent
Batarseh

(10) Patent No.: US 10,968,736 B2
(45) Date of Patent: Apr. 6, 2021

(54) LASER TOOL

(71) Applicant: Saudi Arabian Oil Company, Dhahran (SA)

(72) Inventor: Sameeh Issa Batarseh, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 177 days.

(21) Appl. No.: 15/982,398

(22) Filed: May 17, 2018

(65) Prior Publication Data

US 2019/0353032 A1 Nov. 21, 2019

(51) Int. Cl.
*E21B 47/135* (2012.01)
*E21B 43/247* (2006.01)
*E21B 12/06* (2006.01)

(52) U.S. Cl.
CPC ..... *E21B 47/135* (2020.05); *E21B 12/06* (2013.01); *E21B 43/247* (2013.01)

(58) Field of Classification Search
CPC ..... E21B 47/123; E21B 12/06; E21B 43/247; E21B 7/15; E21B 43/11; E21B 7/14
See application file for complete search history.

(56) References Cited

U.S. PATENT DOCUMENTS 6,518,543 B1 2/2003 Benz et al.
6,755,262 B2 6/2004 Parker
6,888,097 B2 5/2005 Batarseh
7,490,664 B2 * 2/2009 Skinner ..... E21B 7/15 166/57
8,627,901 B1 1/2014 Underwood et al.
8,755,262 B2 6/2014 Ueki
9,217,291 B2 12/2015 Batarseh
9,353,612 B2 5/2016 Batarseh
(Continued)

FOREIGN PATENT DOCUMENTS

CN 203081295 U 7/2013
CN 203334954 U 12/2013
(Continued)

OTHER PUBLICATIONS

International Search Report for PCT/IB2018/057582, 6 pages (dated Feb. 6, 2019).
(Continued)

*Primary Examiner* — Michael R Wills, III
(74) *Attorney, Agent, or Firm* — Choate, Hall & Stewart LLP; Charles E. Lyon; Alexander D. Augst

(57) ABSTRACT

An example laser tool is configured to operate within a wellbore of a hydrocarbon-bearing rock formation. The tool includes one or more optical transmission media. The one or more optical transmission media are part of an optical path originating at a laser generator configured to generate a laser beam. The one or more optical transmission media are for passing the laser beam. The tool includes a mono-optic element that is part of the optical path. The mono-optic element is for receiving the laser beam from the one or more optical transmission media and for altering at least one of a geometry or a direction of the laser beam for output to the hydrocarbon-bearing rock formation. The tool also includes one or more sensors to monitor one or more conditions in the wellbore and to output signals based on the one or more conditions.

17 Claims, 4 Drawing Sheets

(56) References Cited

U.S. PATENT DOCUMENTS

| | | | | |
|---|---|---|---|---|
| 9,932,803 | B2 | 4/2018 | Batarseh et al. | |
| 2006/0102343 | A1 | 5/2006 | Skinner et al. | |
| 2006/0231257 | A1* | 10/2006 | Reed | B28D 1/00 166/297 |
| 2006/0237233 | A1* | 10/2006 | Reed | B23K 26/0604 175/56 |
| 2010/0078414 | A1 | 4/2010 | Perry et al. | |
| 2011/0278270 | A1* | 11/2011 | Braga | B28D 1/146 219/121.71 |
| 2013/0000906 | A1* | 1/2013 | Schultz | E21B 29/02 166/297 |
| 2014/0305660 | A1* | 10/2014 | Ash | E21B 17/07 166/381 |
| 2014/0360778 | A1 | 12/2014 | Batarseh | |
| 2017/0191314 | A1 | 7/2017 | Faircloth et al. | |

FOREIGN PATENT DOCUMENTS

| | | | |
|---|---|---|---|
| GB | 2420135 | A | 5/2006 |
| WO | WO-2012/031009 | A1 | 3/2012 |
| WO | WO-2016/090229 | A1 | 6/2016 |
| WO | WO-2019/220198 | A1 | 11/2019 |

OTHER PUBLICATIONS

Written Opinion for PCT/IB2018/057582, 8 pages (dated Feb. 6, 2019).

Xu, Z. et al., Rock Perforation by Pulsed ND: Yag Laser, Proceedings of the 23rd International Congress on Applications of Lasers and Electro Optics, 5 pages (2004).

Written Opinion of the International Preliminary Examining Authority for PCT/IB2018/057582, 4 pages (dated Apr. 20, 2020).

* cited by examiner

LASER TOOL

TECHNICAL FIELD

This specification describes examples of laser tools that are usable in a wellbore to create fluid flow paths through hydrocarbon-bearing rock formations.

BACKGROUND

Wellbore stimulation is a branch of petroleum engineering focused on ways to enhance the flow of hydrocarbons from a rock formation into a wellbore. The flow of hydrocarbons from a rock formation into a wellbore is based, at least in part, on a permeability of the rock formation. When the permeability of the rock formation is small, stimulation may be applied to enhance the flow of hydrocarbons from the rock formation. In some cases, stimulation may be performed in stages. For example, a first stage of the stimulation may include perforating walls of the wellbore to create tunnels through the walls and through the rock formation. A second stage of the stimulation may include pumping fluids into the tunnels. The fluids fracture rock in the rock formation, thereby creating a fluid flow path into the wellbore. Hydrocarbons, such as oil, may flow along the fluid flow path and into the wellbore.

SUMMARY

An example laser tool is configured to operate within a wellbore of a hydrocarbon-bearing rock formation. The laser tool includes one or more optical transmission media. The one or more optical transmission media are part of an optical path originating at a laser generator configured to generate a laser beam. The one or more optical transmission media are for passing the laser beam. The laser tool includes a mono-optic element that is part of the optical path. The mono-optic element is for receiving the laser beam from the one or more optical transmission media and for altering at least one of a geometry or a direction of the laser beam for output to the hydrocarbon-bearing rock formation. The laser tool also includes one or more sensors to monitor one or more conditions in the wellbore and to output signals based on the one or more conditions. The laser tool may include one or more of the following features, either alone or in combination.

The laser tool may include a focusing system configured to focus or to collimate the laser beam prior to output. The focusing system may include the mono-optic element, which may be configured to focus or to collimate the laser beam. The mono-optic element may be at least one of a crystal, a lens, a mirror, a prism, a cube, a cylinder, or a cone. The mono-optic element may be a structure comprised of two or more of: a crystal, a lens, a mirror, a prism, a cube, a cylinder, or a cone.

The focusing system may include a laser muzzle to discharge the laser beam from the focusing system. The focusing system may include a fluid knife proximate to a part of the mono-optic element that faces the laser muzzle. The focusing system may also include a purging nozzle proximate to the laser muzzle, a vacuum nozzle proximate to the laser muzzle, and a temperature sensor adjacent to the laser muzzle. The fluid knife is configured to sweep the mono-optic element. The purging nozzle is configured to remove dust and vapor from the path of the laser beam. The vacuum nozzle is configured to collect dust and vapor from the path of the laser beam.

The laser tool may include a stabilizer that is attached to the laser tool and that is configured to hold the laser tool in place relative to a casing in a wellbore. The laser tool may include a shock absorber located at an end of the laser tool and configured to absorb impact to a distal end of the laser tool.

An example system may include a first laser tool, a second laser tool, and a motion system to position the first laser tool and the second laser tool within a wellbore. The motion system may include one or more cables that are movable within the wellbore to position the first laser tool and the second laser tool.

An example method is performed within a wellbore of a hydrocarbon-bearing rock formation. The method includes passing, through one or more optical transmission media, a laser beam generated by a laser generator at an origin of an optical path comprising the one or more optical transmission media. The method includes rotating, about an axis, a laser tool comprising a mono-optic element that is part of the optical path. The mono-optic element receives the laser beam from the one or more optical transmission media and alters at least one of a geometry or a direction of the laser beam for output to the hydrocarbon-bearing rock formation. The method includes monitoring, using one or more sensors, one or more conditions in the wellbore during operation of the laser tool. Signals are output that are based on the one or more conditions. The method may include one or more of the following features, either alone or in combination.

The mono-optic element may be at least one of a crystal, a lens, a mirror, a prism, a cube, a cylinder, or a cone. The mono-optic element may be a structure comprised of two or more of: a crystal, a lens, a mirror, a prism, a cube, a cylinder, or a cone.

The method may include positioning the laser tool within the wellbore by moving the laser tool uphole or downhole within the wellbore. The method may include rotating the laser tool to target a different area of the hydrocarbon-bearing rock formation. The method may include operating the laser generator in a run mode. In the run mode, the optical transmission media connected to the laser generator conducts the laser beam to a focusing system of the laser tool. The run mode may include a continuous mode, in which the laser generator operates continuously until a target penetration depth is reached. The run mode may include a cycling mode, in which the laser generator is cycled between on periods and off periods. During an on period, the laser beam is conducted from the laser generator to the focusing system.

The method may include focusing or collimating the laser beam using the mono-optic element. The method may include sweeping the mono-optic element using a fluid knife, purging the path of the laser using a purging nozzle, sublimating the hydrocarbon-bearing rock formation using the laser beam to create a tunnel to the target penetration depth, and vacuuming dust and vapor using a vacuum nozzle. The method may include purging a path of the laser beam using the purging nozzle, and vacuuming the dust and vapor using the vacuum nozzle.

Any two or more of the features described in this specification, including in this summary section, may be combined to form implementations not specifically described in this specification.

At least part of the processes and systems described in this specification may be controlled by executing, on one or more processing devices, instructions that are stored on one or more non-transitory machine-readable storage media. Examples of non-transitory machine-readable storage media include, but are not limited to, read-only memory, an optical disk drive, memory disk drive, random access memory, and the like. At least part of the processes and systems described in this specification may be controlled using a computing system comprised of one or more processing devices and memory storing instructions that are executable by the one or more processing devices to perform various control operations.

The details of one or more implementations are set forth in the accompanying drawings and the description. Other features and advantages will be apparent from the description and drawings, and from the claims.

DESCRIPTION OF THE DRAWINGS

Like reference numerals in the figures indicate like elements.

DETAILED DESCRIPTION

Figure 1:
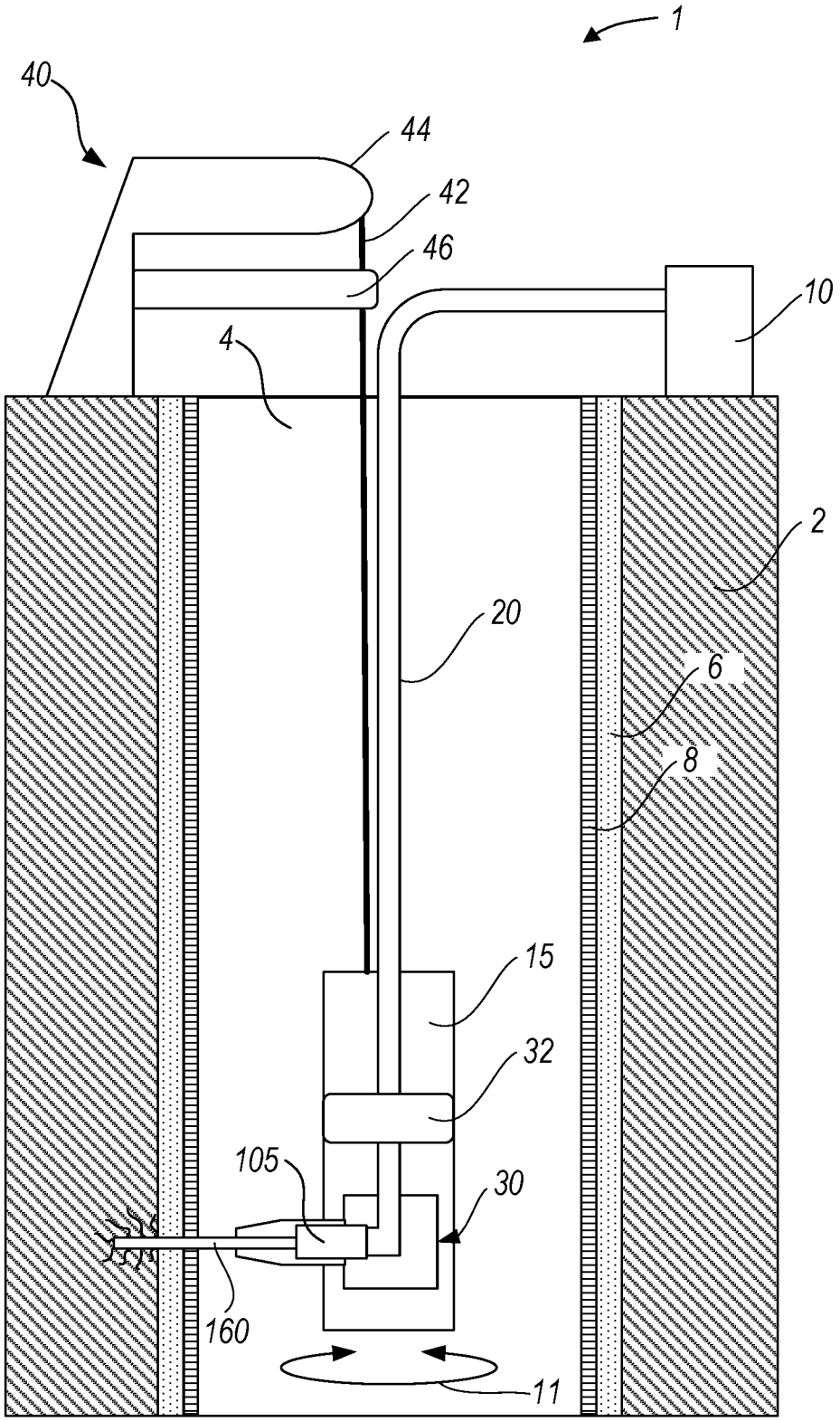
FIG. 1 is a cross-sectional view of an example system for creating fluid flow paths through hydrocarbon-bearing rock formations.

This specification describes examples of laser tools for creating fluid flow paths through hydrocarbon-bearing rock formations. An example laser tool is introduced into a wellbore that extends through a hydrocarbon-bearing rock formation. The laser tool may operate downhole to create a fluid flow path through a wellbore casing and the rock formation. The fluid flow path is created by controlling the laser tool to direct a laser beam to rock in the rock formation. In this example, the laser beam has an energy density that is great enough to cause at least some of the rock in the rock formation to sublimate. Sublimation includes changing from a solid phase directly into a gaseous phase without first changing into a liquid phase. In the case of rock, sublimation occurs when the temperature of the rock, which is increased by the laser beam, exceeds a threshold. That threshold is known as the sublimation point and may be different for different types of rock. In this example, the sublimation of the rock creates tunnels or cracks through the rock formation. Fluids may be introduced into those tunnels or cracks to fracture the rock formation and thereby promote the flow of production fluid, such as oil, from the rock formation into the wellbore.

An implementation of the laser tool described in the preceding paragraph includes a focusing system that holds a mono-optic element. An example of a mono-optic element is a unitary optical structure configured—for example, structured, arranged, or both—to manipulate a laser beam. Manipulation includes altering one or more properties of the laser beam. Examples of mono-optic elements include a crystal and a lens. Other examples of mono-optic elements are provided in this specification.

The mono-optic element is configured to receive, via an optical path, a raw laser beam output from a laser generator. The optical path may include one or more optical transmission media, such as fiber optic cables, that are strung downhole. The received laser beam is "raw" in the sense that the laser beam has not been acted-upon by the mono-optic element. The mono-optic element manipulates the raw laser beam by altering a geometry of the raw laser beam, a direction of the raw laser beam, or both the geometry and the direction of the raw laser beam. The laser beam output by the mono-optic element is directed to the rock formation where, as described previously, the laser beam heats rock to cause tunnels or cracks to form in the rock formation. The laser tool is configured to rotate, which also affects the direction of the laser beam.

The example laser tool may also include one or more sensors to monitor environmental conditions in the wellbore and to output signals indicative of the environmental conditions. Examples of the sensors may include temperature sensors to measure temperature downhole, pressure sensors to measure pressure downhole, and acoustic sensors to measure noise levels downhole. Other sensors may also be used as described in this specification. Signals received from the sensors may indicate that there are problems inside the wellbore or that there are problems with the laser tool. A drilling engineer may take corrective action based on these signals. For example, if a temperature or pressure downhole is such that drilling equipment, such as the laser tool, may be damaged, that equipment may be withdrawn from the wellbore.

FIG. 1 shows components of a system 1 that includes an implementation of a laser tool 30 of the type described in the preceding paragraphs. At least part of system 1 is disposed within wellbore 4. Wellbore 4 passes through a hydrocarbon-bearing rock formation 2 ("rock formation 2"). Rock formation 2 may include various materials, such as limestone, shale, or sandstone. Each of these materials has a different sublimation point. The sublimation point may be affected by properties of the material, such as the density of the material and the porosity of the material. A casing 8 is cemented 6 in place to reinforce the wellbore against rock formation 2. A string 15 that houses the laser tool 30 is run downhole through casing 8.

Laser tool 30 is configured to output a laser beam 160. In this example, the laser tool is also configured to rotate about an axis in the wellbore, such as a central axis of the wellbore. In some implementations, the laser tool 30 is mounted on an axle (not shown) for rotation. A motor 32 may be included in string 15 to implement the rotation of laser tool 30 about the axle. In some implementations, the entire string 15 is connected to a drive arrangement 46 that is configured to rotate string 15 and thus laser tool 30. Rotation of the laser tool is identified by circular arrow 11. During rotation, laser beam 160 may sweep the entire circumference of the wellbore. That is, the laser tool may rotate a full 360°. In some cases, the laser tool may rotate less than 360°.

Laser tool 30 is configured to direct laser beam 160 parallel to a surface containing the wellhead or at an angle that is not parallel to the surface. Laser tool 30 includes a mono-optic element 105 that is configured to affect the output of the laser beam. For example, the mono-optic element may direct, collimate, focus, defocus, or otherwise manipulate the direction or geometry of the laser beam 160 prior to output. Operation of the laser tool and mono-optic element are described subsequently.

System 1 includes a laser generating unit, such as laser generator 10. Laser generator 10 is configured to generate a laser beam and to output the laser beam to the laser tool. In some implementations, laser generator 10 is at the surface near to the wellhead. In some implementations, laser generator 10 is downhole, in whole or in part. The laser beam output by laser generator 10 is referred to as a raw laser beam because it has not been manipulated by laser tool 30. Examples of laser generator 10 include ytterbium lasers, erbium lasers, neodymium lasers, dysprosium lasers, praseodymium lasers, and thulium lasers. In an example implementation, laser generator 10 is a 5.34 kilowatt (kW) ytterbium-doped, multi-clad fiber laser.

In some implementations, laser generator 10 can be configured to output laser beams having different energy densities. Laser beams having different energy densities may be useful for rock formations that are composed of different materials having different sublimation points. For example, laser beams having different energy densities may be used to sublimate different types of rocks in a rock formation. In some implementations, the operation of laser generator 10 is programmable. For example, laser generator 10 may be programmed to vary the optical properties of the laser beam or the energy density of the laser beam.

In some implementations, the laser beam output by laser generator 10 has an energy density that is sufficient to heat at least some rock to its sublimation point. In this regard, the energy density of a laser beam is a function of the average power output of the laser generator during laser beam output. In some implementations, the average power output of laser generator 10 is in one or more of the following ranges: between 500 Watts (W) and 1000 W, between 1000 W and 1500 W, between 1500 W and 2000 W, between 2000 W and 2500 W, between 2500 W and 3000 W, between 3000 W and 3500 W, between 3500 W and 4000 W, between 4000 W and 4500 W, between 4500 W and 5000 W, between 5000 W and 5500 W, between 5500 W and 6000 W, between 6000 W and 6500 W, or between 6500 W and 7000 W.

Laser generator 10 is part of an optical path that includes laser tool 30 and one or more optical transmission media. This optical path extends to the mono-optic element in the laser tool. An example of an optical transmission medium that may be used is fiber optic cable 20. Fiber optic cable 20 may include a single fiber optic strand, multiple fiber optic strands, or multiple fiber optic cables that are run downhole from laser generator 10. Fiber optic cable 20 conducts the raw laser beam output by laser generator 10 to the laser tool 30. As described, the laser tool may manipulate the laser beam to change the geometry of the laser beam, the direction of the laser beam, or both. A laser beam 160 output from the laser tool may penetrate downhole casings and cement to reach the rock formation. In the example of FIG. 1, this means that the laser beam exits string 15 and penetrates casing 8 and cement 6 in order to reach the rock formation 2. The system may be configured to minimize, or to reduce, power loss along the optical path. In some implementations, each laser beam 160 has a power density or energy density (at the laser beam's target) that is 70% or more of the power density or energy density of the laser beam output by laser generator 10.

The duration that the laser beam is applied to the rock in the formation may affect the extent to which the laser beam sublimates, and therefore penetrates, the rock. For example, the more time that the laser beam is applied to a particular location, the greater the penetration of the rock at that location may be.

In some implementations, laser generator 10 is configured to operate in a run mode until a target penetration depth is reached. A run mode may include a cycling mode, a continuous mode, or both. During the continuous mode, laser generator 10 generates a laser beam continuously, for example, without interruption. In the continuous mode, laser generator 10 produces the laser beam until a target penetration depth is reached. During the cycling mode, laser generator 10 is cycled between being on and being off. In some implementations, laser generator 10 generates a laser beam during the on period. In some implementations, laser generator 10 does not generate a laser beam during the off period. In some implementations, laser generator 10 generates a laser beam during the off period, but the laser beam is interrupted before reaching laser tool 30 downhole. For example, the laser beam may be safely diverted or the laser beam may be blocked from output. Laser generator 10 may operate in the cycling mode to reduce the chances of one or more components of the system overheating, to clear a path of the laser beam, or both.

In the cycling mode, a duration of an on period can be the same as a duration of an off period. In the cycling mode, the duration of the on period can be greater than the duration of the off period, or the duration of the on period can be less than the duration of the off period. The duration of each on period and of each off period may be based on a target penetration depth. Other factors that may contribute to the duration of on periods and the duration of off periods include, for example, rock type, purging methods, laser beam diameter, and laser power.

The duration of each on period and of each off period may be determined by experimentation. Experiments on a sample of rock from a formation may be conducted prior to, or after, lowering the laser tool into the wellbore. Such experiments may be conducted to determine, for a cycling mode, optimal or improved durations of each on period and of each off period. Alternatively or additionally, the duration of each on period and of each off period may be determined by geological methods. For example, seismic data or subsurface maps of rock formation 2 may be analyzed and the duration may be based on the result of the analysis or analyses.

In some implementations, on periods and off periods can last between one and five seconds. In an example operation, the on period lasts for 4 seconds and the off period lasts for 4 seconds. Such operation may enable the laser beam to penetrates a rock formation comprised of berea sandstone to a depth of 30 centimeters (cm).

In this regard, the selection of a run mode may be based on a type of rock to penetrate and a target penetration depth. A rock formation that may require the laser generator to operate in the cycling mode includes, for example, sandstones having a large quartz content, such as berea sandstone. A rock formation that may require the laser generator to operate in the continuous mode includes, for example, limestone.

Target penetration depth may be determined based on a variety of factors, such as a type of material or rock in the formation, a maximum horizontal stress of material or rock in the formation, a compressive strength of material or rock in the formation, a desired penetration depth, or a combination of two or more of these features. In some examples, penetration depth is measured from the interior wall of the wellbore. Examples of penetration depths may be on the order of millimeters, centimeters, or meters. Examples of penetration depths may include penetration depths between 1 millimeter (mm) and 10 mm, penetration depths between 1 centimeter (cm) and 100 cm, and penetration depths between 1 meter (m) and 200 m.

System 1 includes a motion system 40. The motion system can include, for example, a hydraulic system, an electrical system, or a motor operated system to move the laser tool to a target location. In this regard, the motion system is configured to move the laser tool to different locations, such as depths, within the wellbore 4. To this end, the motion system includes at least one component that is movable within the wellbore. For example, the motion system may include cable 42 that is configured to move uphole or downhole to enable the laser tool reach a target elevation. In an example, cable 42 may be at least partially spooled on a reel. A motor 44 may be connected to the reel. Motor 44 is configured to drive the reel to wind or to unwind cable 42. This causes cable 42 to move uphole or downhole within the wellbore.

Cable 42 is connected physically to string 15 such that movement of cable 42 translates to corresponding movement of string 15. As noted, string 15 houses laser tool 30. Thus, when string 15 moves, laser tool 30 also moves. Accordingly, the length of cable 42 within the wellbore may be controlled to position the laser tool.

In some implementations, the motion system uses components other than cable 42 to move the laser tool. For example, the motion system may use a coiled tubing string to connect to string 15. The coiled tubing string may be moved uphole or downhole in the same manner as cable 42 is moved uphole or downhole.

In some implementations, the motion system can include a rotational drive system to implement rotation of string 15, and thus rotation of laser tool 30, about an axis in the wellbore. In an example implementation, the rotational drive system includes a motor and a drive train, such as an axle or rack and pinion arrangement (not shown), connected to cable 42 to implement the rotation of string 15.

A computing system may be configured—for example, programmed—to control positioning and operation of the laser tool. Examples of computing systems that may be used are described in this specification. Alternatively, or in addition, the laser generator may be configured to control positioning and operation of the laser tool. For example, the laser generator may include circuitry or may include an on-board computing system to implement control over the positioning and operation of the laser tool. In either case, signals may be exchanged with the motion system and the laser tool via wired or wireless connections. In some implementations, signals may be exchanged with the motion system or laser tool via fiber optic media.

During operation, laser tool 30 may relay its angular position to a control system, such as the computing system or the laser generator. In response, the control system may to operate the tool to form tunnels or cracks in the rock formation.

Materials used to implement the downhole components of system 1 may be resistant to the temperatures, pressures, and vibrations that may be experienced within wellbore 4. The materials may protect the system from fluids, dust, and debris. In some implementations, the materials include one or more of iron, nickel, chrome, manganese, molybdenum, niobium, cobalt, copper, titanium, silicon, carbon, sulfur, phosphorus, boron, tungsten, steel, steel alloys, stainless steel, or tungsten carbide.

Figure 2:
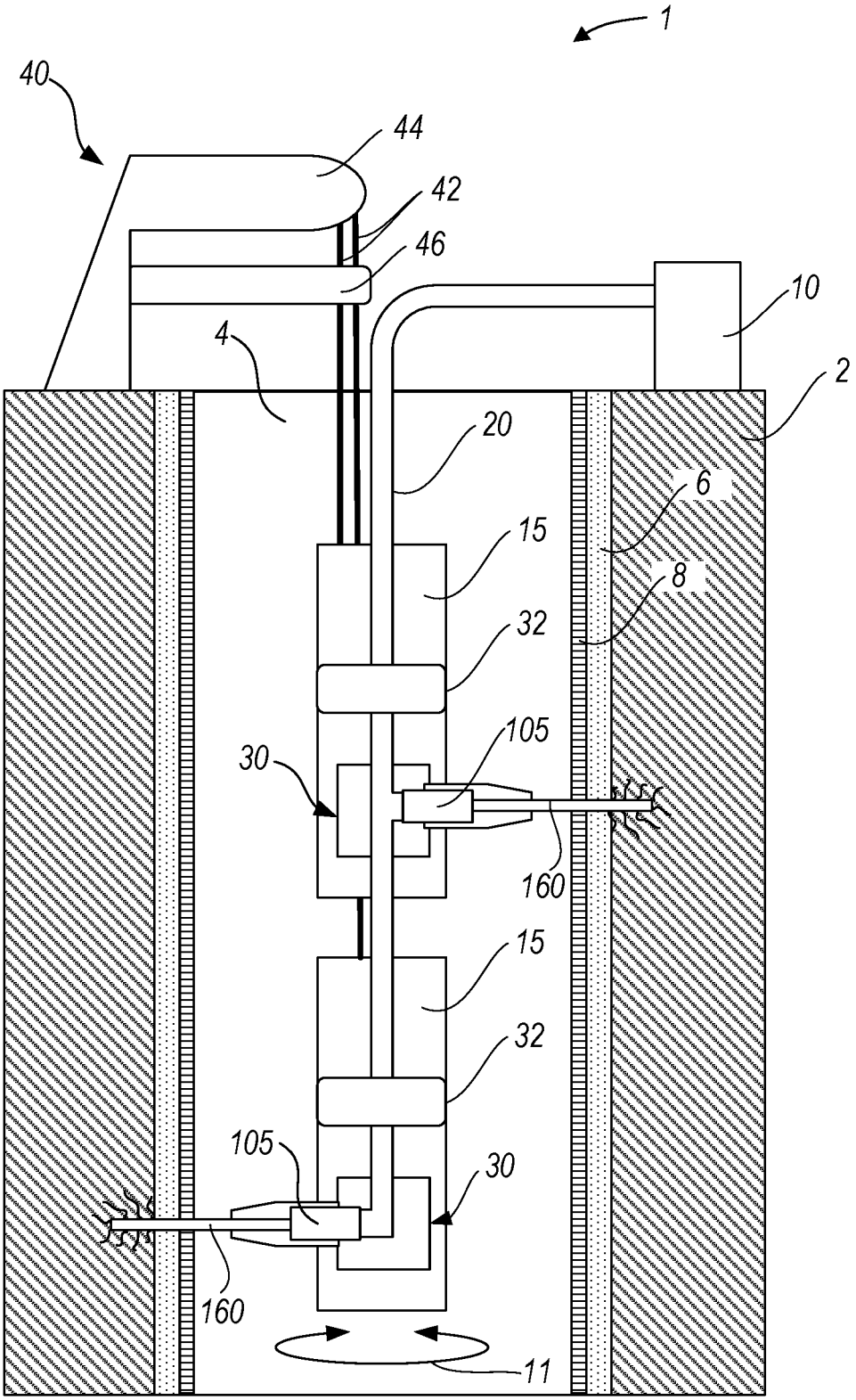
FIG. 2 is a cross-sectional view of another example system for creating fluid flow paths through hydrocarbon-bearing rock formations.

FIG. 2 shows components of an example system having multiple laser tools of the type described with respect to FIG. 1. In FIG. 2, each of the individual laser tools may have the same structure and function as laser tool 30 of FIG. 1. Multiple laser tools may be housed within the same string 15 or may be housed within separate strings. In the example of FIG. 2, there are two strings 15 disposed at different depths within the wellbore, with each string housing an individual laser tool 30. Each string 15 is mounted separately on motion system 40 by a separate cable 42. This configuration enables independent control over the location and angular rotation of each string 15. In some implementations, each string 15 is mounted to the same cable on motion system 40. This configuration allows a single cable to control the position of multiple tools.

In the configuration of FIG. 2, each of the laser tools 30 may be connected to a single laser generator via a common optical path. Alternatively, each of the laser tools 30 may be connected to a different laser generator via a different optical path.

Figure 3B:
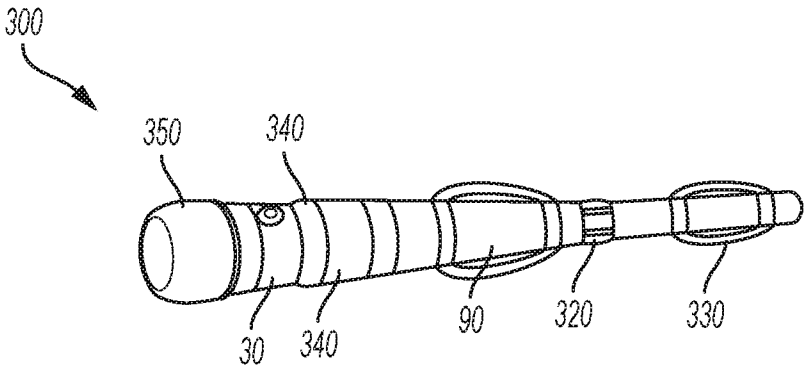
FIG. 3B is a perspective view of the components of FIG. 3A.
Figure 3C:
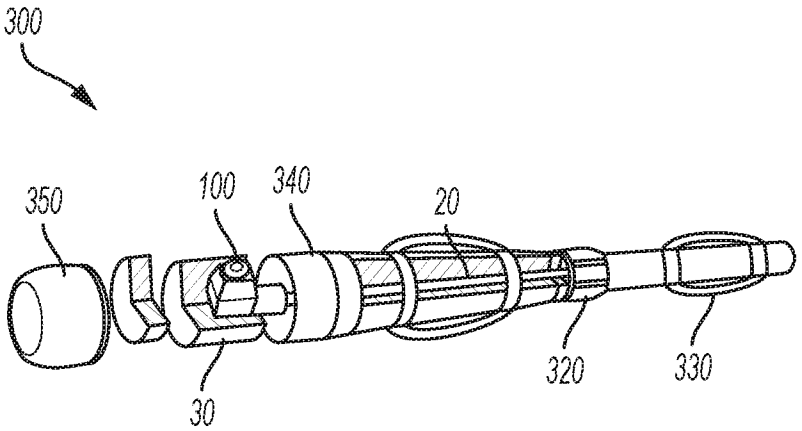
FIG. 3C is a perspective, exploded, cut-away view of the components of FIG. 3A.
Figure 3A:
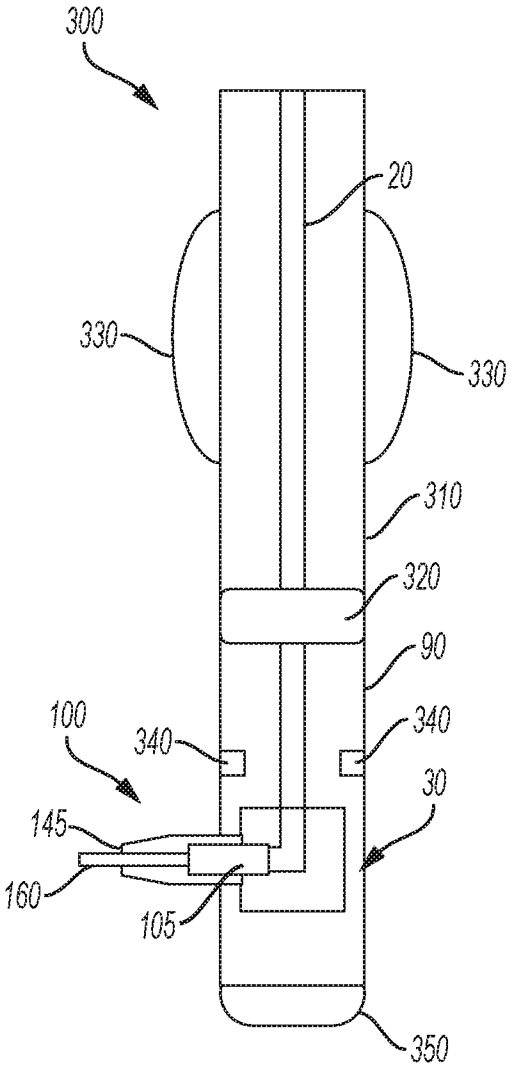
FIG. 3A is a cross-sectional view of components, including a laser tool, for creating fluid flow paths through hydrocarbon-bearing rock formations.

FIGS. 3A, 3B, and 3C show an example implementation (string 300) of the string 15 of FIGS. 1 and 2, including the laser tool. String 300 includes laser tool 30, fiber optic cable 20, and outer case 310. Outer case 310 is a protective cover and can be made of any material that is resistant to the temperatures, pressures, or vibrations experienced within wellbore 4. Fiber optic cable 20 is part of the optical transmission path that extends between the laser generator and the laser tool.

String 300 includes an example orientation system 320. Orientation system 320 is configured to control the angular position of laser tool 30, including mono-optic element 105, to direct an output laser beam at a target. Orientation system 320 may include a hydraulic system, an electrical system, or a motor-operated system to implement rotational motion of the laser tool. In some implementations, orientation system 320 includes an electric motor and an axle on which laser tool 30 is mounted. The electric motor controls rotation around the axle. Orientation system 320 includes a control system, a power supply, and a communication device configured to exchange communications with an a control system, such as a computing device or a laser generator. The communications exchanged between the control system and the orientation system may be used to control the angular position of the laser tool. The orientation system may be used in combination with rotation of the string containing the laser tool to move the laser tool at a target angular position. For example, the orientation system may provide for finer angular control than rotation of the string.

String 300 includes one or more stabilizers 330. The stabilizers are configured to resist unwanted movement of string 300 inside the wellbore. In some implementations, stabilizers 330 anchor the string 300 in place by maintaining contact with an interior wall of wellbore 4 at least for the duration of operation of laser tool 30. This duration may include a period during which laser beam is output. Stabilizers 330 can be made of metal, polymer, or of any other material. In some implementations, stabilizers 330 include a spring or a damper, or both. In some implementations, stabilizers 330 include a solid piece of a deformable material. In some implementations, stabilizers 330 include a hydraulic or pneumatic device.

String 300 may include one or more sensors 340 to monitor one or more environmental conditions in the wellbore, one or more conditions of string 300, or both environmental conditions and conditions of the string. Sensors 340 can be attached to, or integrated into, string 300. In some implementations, sensors 340 can be configured to monitor temperature in the wellbore, surface temperature of string 300, mechanical stress in a wall of the wellbore, mechanical stress in string 300, a flow of fluids in the wellbore, a presence of debris in the wellbore, fluid pressure in the wellbore, radiation in the wellbore, noise in the wellbore, magnetic fields in the wellbore, or a combination of two or more of these conditions.

In some implementations, sensors 340 may include one or more temperature sensors, one or more acoustic sensors, or one or more pressure sensors, one or more strain sensors, or some combination of these or other sensors. In an example implementation, laser tool 30 can include at least one temperature sensor. The temperature sensor is configured to measure a temperate at its current location and to output signals representing that temperature. The signals may be output to a computing system located on the surface. In response to signals received from the temperature sensor, the computing system may control operation of the system. For example, if the signals indicate that the temperature downhole is great enough to cause damage to downhole equipment, the computing system may instruct that action be taken. For example, all or some downhole equipment, including the laser tool, may be extracted from the well. In some implementations, data collected from the temperature sensor can be used to monitor the intensity of laser beam 160. Such measurements may be used to adjust the beam energy.

In some implementations, the signals may indicate a temperature that exceeds a set point that has been established for the laser tool or downhole equipment. For example, the set point may represent a maximum temperature that the laser tool can withstand without overheating. If the set point is reached, the laser tool may be shut-down. The value of the set point may vary based on type of laser being used or the materials used for the manufacture of the laser tool, for example. Examples of set points include 1000° Celsius (C), 1200° C., 1400° C., 1600° C., 1800° C., 2000° C., 2500° C., 3000° C., 3500° C., 4000° C., 4500° C., 5000° C., 5500° C., and 6000° C. In an example implementation, the set point is between 1425° C. and 1450° C.

In some implementations, string 300 includes shock absorber 350 to mitigate mechanical impacts to the laser tool. In some examples, shock absorber 350 can be made of metal, polymer, or any type of material that is resistant to temperatures, pressures, vibrations, and impacts that may be experienced within a wellbore. In some implementations, shock absorber 350 is located at a distal end of string 300. In some implementations, shock absorber 350 includes a spring, a damper, or both a spring and a damper. In some implementations, shock absorber 350 includes a solid piece of a deformable material. In some implementations, shock absorber 350 may be implemented using a hydraulic or pneumatic device.

In this example, laser tool 30 includes focusing system 100 to focus the laser beam. The laser beam passes through the focusing system and exits the focusing system through muzzle 145. Focusing system 100 is configured to taper such that a diameter of focusing system 100 is smaller at its output than at the intersection to the outer case. The tapering of the focusing system can reduce the chances that dust, vaporized rock, or both, will enter the tool.

The focusing system includes mono-optic element 105. The mono-optic element is configured to receive a raw laser beam from the optical transmission path and to manipulate the raw laser beam to produce a laser beam output, such as laser beam 160. As described, manipulating the laser beam may include altering a direction of the laser beam or changing a geometry of the laser beam. The geometry of the laser beam may include the cross-sectional shape of the laser beam. For example, the cross-sectional shape of the laser beam may change from circular to oval or from oval to rectangular. The geometry of the laser beam may include the size of the laser beam. For example, during focusing, the laser beam may decrease in cross-sectional diameter and volume, but maintain its overall shape. During defocusing—or scattering—the laser beam may increase in cross-sectional diameter and in volume.

Figure 4:
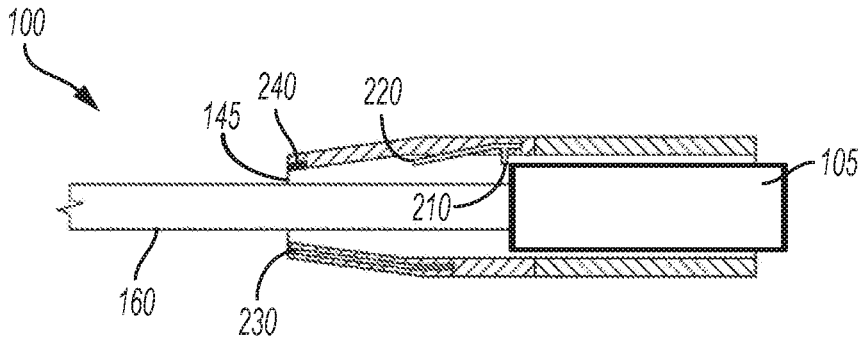
FIG. 4 is a cross-sectional view of an example focusing system that is usable to manipulate a laser beam output of the laser tool.

Components of an example focusing system 100 that can be part of the laser tool are shown in FIG. 4. In this regard, FIG. 4 shows mono-optic element 105. In some examples, a mono-optic element may include a crystal, a lens, a mirror, a prism, a cube, a cylinder, or a cone. In some examples, mono-optic element 105 is or includes a cylinder. One or both bases of the cylinder can be flat, angled, conical, concave, or convex. In some examples, mono-optic element 105 is made of glass, plastic, quartz, crystal, or any other material capable of directing, focusing, or otherwise affecting a geometry or other property of a laser beam. In some examples, mono-optic element 105 may be a single optical structure comprised of two or more components, such as a crystal, a lens, a mirror, a prism, a cube, a cylinder, or a cone.

In some implementations, an initial position, an optical property, or both an initial position and an optical property of mono-optic element 105 is established prior to output of a laser beam. The position of the mono-optic element may be adjusted by changing a position of the laser tool, as described previously. In some implementations, the position of the laser tool, and thus of the mono-optic element, can be adjusted while the laser beam is being output. In some implementations, the position of mono-optic element 105 can be adjusted while the laser beam is off. An optical property of the mono-optic element may be adjusted, for example, by heating mono-optic element 105, for example using one or more electric heating elements in contact with the mono-optic element. In some implementations, an optical property of mono-optic element 105 can be adjusted while the laser beam is being output. In some implementations, an optical property of mono-optic element 105 can be adjusted while the laser beam is off.

Focusing system 100 can include one or more fluid knives 210 and one or more nozzles, such as purging nozzles 220 and vacuum nozzles 230. Fluid knives 210, purging nozzles 220, and vacuum nozzles 230 may be configured to operate together to reduce or to eliminate dust and vapor in the path of collimated laser beam. Dust or vapor in the path of laser the laser beam may disrupt, bend, or scatter the laser beam.

A fluid knife 210 is configured to sweep dust or vapor from mono-optic element 105. In some implementations, fluid knife 210 is proximate to mono-optic element 105 and is configured to discharge a fluid or a gas onto, or across, a surface of mono-optic element 105. Examples of gas that may be used include air and nitrogen. In some implementations, the combined operation of fluid knives 210 and purging nozzles 220 can create an unobstructed path for transmission of the laser beam 160 from mono-optic element 105 to a surface of a wellbore or rock formation.

In this regard, purging nozzles 220 are configured to clear a path between mono-optic element 105 and a hydrocarbon-bearing rock formation by discharging a purging medium on or near laser muzzle 145. The choice of purging media to use, such as liquid or gas, can be based on the type or rock in the formation and the pressure of a reservoir associated with the formation. In some implementations, the purging media can be, or include, a non-reactive, non-damaging gas such as nitrogen. A gas purging medium may be appropriate when fluid pressure in the wellbore is small, for example, less than 50000 kilopascals, less than 25000 kilopascals, less than 10000 kilopascals, less than 5000 kilopascals, less than 2500 kilopascals, less than 1000 kilopascals, or less than 500 kilopascals. In some implementations, purging nozzles 220 lie flush inside of focusing system 100 between fluid knife 210 and laser muzzle 145 so as not to obstruct the path of laser beam 160. In some implementations, purging may be cyclical. For example, purging may occur while the laser beam is on.

Dust or vapor may be created by sublimation of the rock, as described. Vacuum nozzles 230 may be configured to aspirate or to vacuum such dust or vapor from an area surrounding laser muzzle 145. The dust or vapor can be sent to the surface and analyzed. The dust or vapor can be analyzed to determine a type of the rock and fluids contained in the rock. The vacuum nozzles can be positioned flush with the laser muzzle. The vacuum nozzles may include one, two, three, four, or more nozzles depending, for example, on the quantity of dust and vapor. The size of vacuum nozzles may depend, for example, on the volume of dust or vapor to be removed and the physical requirements of the system to transport the dust to the surface. Vacuum nozzles 230 can operate cyclically or continuously.

Figure 5:
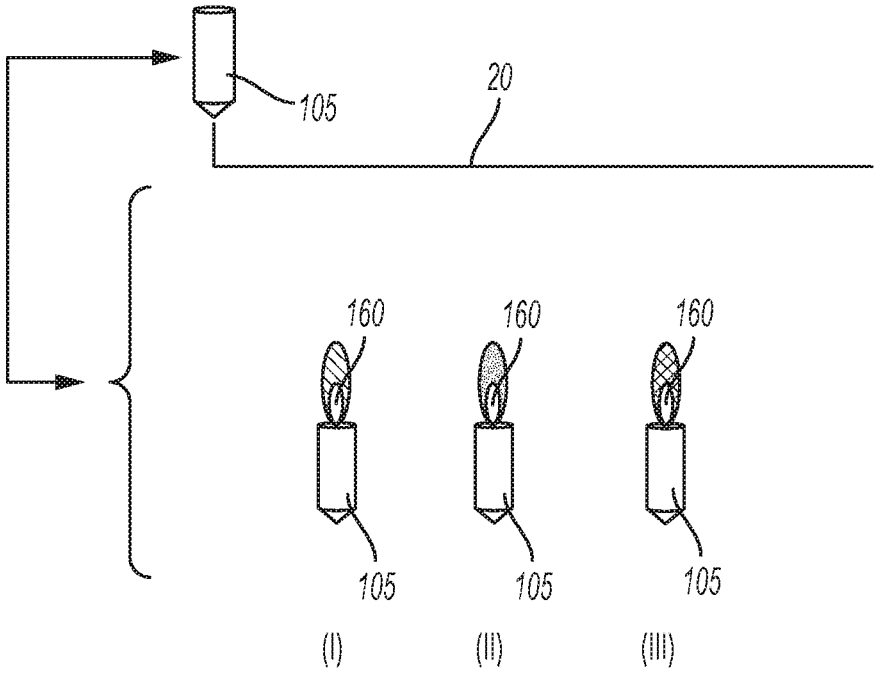
FIG. 5 is a side view of light scatter patterns of three differently-colored laser beams exiting an example mono-optic element.

Laser beams of any wavelength can be used with the laser tool system. FIG. 5 shows example mono-optic element 105 manipulating example laser beams 160 of three different wavelengths. In an example, mono-optic element 105 is placed on an opaque surface. A laser beam is passed from fiber optic cable 20 to the mono-optic element, as described previously. Example laser beams 160 exit mono-optic element 105 and cause light scattering on a surface. The shaded areas represent patterns of light scattered on the surface by the laser beams. The patterns caused by a red laser beam 160 (I—diagonal stripe), a green laser beam 160 (II—dots), and a purple laser beam 160 (III—crosshatch) are similar in size and shape, indicating that the effect of mono-optic element 105 on a laser beam is independent of laser wavelength.

The laser tool may operate downhole to create openings in a casing in the wellbore to repair cementing defects. In an example, a wellbore includes a casing that is cemented in place to reinforce the wellbore against a rock formation. During a cementing procedure, cement slurry is injected between the casing and the rock formation. Defects may occur in the cement layer, which may require remedial cementing. Remedial cementing may involve squeezing additional cement slurry into the space between the casing and the rock formation. The laser tool may be used to generate a laser beam that has an energy density that is great enough to create one or more openings in the casing on or near a cementing defect. The one or more openings may provide access for a cementing tool to squeeze cement slurry through the opening into the defect.

The laser tool may operate downhole to create openings in a casing in the wellbore to provide access for a wellbore drilling tool. In an example, an existing single wellbore is converted to a multilateral well. A multilateral well is a single well having one or more wellbore branches extending from a main borehole. In order to drill a lateral well into a rock formation from an existing wellbore, an opening is created in the casing of the existing wellbore. The laser tool may be used to create an opening in the casing at a desired location for a wellbore branching point. The opening may provide access for drilling equipment to drill the lateral wellbore.

The laser tool may operate downhole to create openings in a casing in the wellbore to provide sand control. During operation of a well, sand or other particles may enter the wellbore causing a reduction in production rates or damage to downhole equipment. The laser tool may be used to create a sand screen in the casing. For example, the laser tool may be used to create a number of openings in the casing that are small enough to prevent or to reduce entry of sand or other particles into the wellbore while maintaining flow of production fluid into the wellbore.

The laser tool may operate downhole to re-open a blocked fluid flow path. Production fluid flows from tunnels or cracks in the rock formation into the wellbore through holes in the wellbore casing and cement layer. These flow paths may become clogged with debris contained in the production fluid. The laser tool may be used to generate a laser beam that has an energy density that is great enough to liquefy or to sublimate the debris in the flow path, allowing for removal of the debris together with production fluid. In an example, the laser tool may be used to liquefy or to sublimate sand or other particles that may have become packed tightly around the sand screen in the casing, thus re-opening the fluid flow path into the wellbore.

The laser tool may operate downhole to weld a wellbore casing or other component of a wellbore. During operation, one or more metal components of a wellbore may become rusted, scaled, corroded, eroded, or otherwise defective. Such defects may be repaired using welding techniques. The laser tool may be used to generate a laser beam that has an energy density that is great enough to liquefy metal or other material to create a weld. In some implementations, material of a wellbore component, such as a casing material, may be melted using the laser tool. Resulting molten material may flow over or into a defect, for example due to gravity, thus covering or repairing the defect upon cooling and hardening. In some implementations, the laser tool may be used in combination with a tool that provides filler material to the defect. The laser tool may be used to melt an amount of filler material positioned on or near a defect. The molten filler material may flow over or into a defect, thus covering or repairing the defect upon cooling and hardening.

The laser tool may operate downhole to heat solid or semi-solid deposits in a wellbore. In producing wells, solid or semi-solid substances may deposit on wellbore walls or on downhole equipment causing reduced flow or blockages in the wellbore or production equipment. Deposits may be or include condensates (solidified hydrocarbons), asphaltene (a solid or semi-solid substance comprised primarily of carbon, hydrogen, nitrogen, oxygen, and sulfur), tar, hydrates (hydrocarbon molecules trapped in ice), waxes, scale (precipitate caused by chemical reactions, for example calcium carbonate scale), or sand. The laser tool may be used to generate a laser beam that has an energy density that is great enough to melt or to reduce the viscosity of deposits. The liquefied deposits can be removed together with production fluid or other fluid present in the wellbore.

At least part of the laser tool system and its various modifications may be controlled by a computer program product, such as a computer program tangibly embodied in one or more information formation carriers. Information carriers include one or more tangible machine-readable storage media. The computer program product may be executed by a data processing apparatus. A data processing apparatus can be a programmable processor, a computer, or multiple computers.

A computer program may be written in any form of programming language, including compiled or interpreted languages. It may be deployed in any form, including as a stand-alone program or as a module, component, subroutine, or other unit suitable for use in a computing environment. A computer program may be deployed to be executed on one computer or on multiple computers. The one computer or multiple computers can be at one site or distributed across multiple sites and interconnected by a network.

Actions associated with implementing the systems may be performed by one or more programmable processors executing one or more computer programs. All or part of the systems may be implemented as special purpose logic circuitry, for example, an field programmable gate array (FPGA) or an ASIC application-specific integrated circuit (ASIC), or both.

Processors suitable for the execution of a computer program include, for example, both general and special purpose microprocessors, and include any one or more processors of any kind of digital computer. Generally, a processor will receive instructions and data from a read-only storage area or a random access storage area, or both. Components of a computer (including a server) include one or more processors for executing instructions and one or more storage area devices for storing instructions and data. Generally, a computer will also include one or more machine-readable storage media, or will be operatively coupled to receive data from, or transfer data to, or both, one or more machine-readable storage media. Machine-readable storage media include mass storage devices for storing data, for example, magnetic, magneto-optical disks, or optical disks. Non-transitory machine-readable storage media suitable for embodying computer program instructions and data include all forms of non-volatile storage area. Non-transitory machine-readable storage media include, for example, semiconductor storage area devices, for example, erasable programmable read-only memory (EPROM), electrically erasable programmable read-only memory (EEPROM), and flash storage area devices. Non-transitory machine-readable storage media include, for example, magnetic disks, for example, internal hard disks or removable disks, magneto-optical disks, and CD-ROM and DVD-ROM disks.

Each computing device may include a hard drive for storing data and computer programs, a processing device (for example, a microprocessor), and memory (for example, RAM) for executing computer programs.

Components of different implementations described in this specification may be combined to form other implementations not specifically set forth in this specification. Components may be left out of the systems described in this specification without adversely affecting their operation.

What is claimed:

1. A laser tool configured to operate within a wellbore of a hydrocarbon-bearing rock formation, the laser tool comprising:

one or more optical transmission media comprising a fiber-optic cable having a first end and a second end, the one or more optical transmission media being part of an optical path originating at a laser generator attached to the first end of the fiber-optic cable and configured to generate a laser beam, the one or more optical transmission media for passing the laser beam;

a mono-optic element that is part of the optical path and that has a first end and a second end, the first end of the mono-optic element attached to the second end of the fiber-optic cable such that the mono-optic element receives the laser beam directly from the second end of the fiber-optic cable, the mono-optic element configured to alter at least one of a geometry or a direction of the laser beam for output to the hydrocarbon-bearing rock formation from the second end of the mono-optic element, the mono-optic element comprising at least one of a prism, a cube, and a cone; and one or more sensors to monitor one or more conditions in the wellbore and to output signals based on the one or more conditions.

2. The laser tool of claim 1, comprising a focusing system configured to focus or to collimate the laser beam prior to output, the focusing system comprising the mono-optic element, where the mono-optic element is configured to focus or to collimate the laser beam prior to output.

3. The laser tool of claim 2, where the focusing system comprises a laser muzzle to discharge the laser beam from the focusing system, a fluid knife proximate to a part of the mono-optic element that faces the laser muzzle, a purging nozzle proximate to the laser muzzle, a vacuum nozzle proximate to the laser muzzle, and a temperature sensor adjacent to the laser muzzle, where the fluid knife is configured to sweep the mono-optic element, the purging nozzle is configured to remove dust and vapor from a path of the laser beam, and the vacuum nozzle is configured to collect dust and vapor from the path.

4. The laser tool of claim 1, further comprising a stabilizer attached to the laser tool and configured to hold the laser tool in place relative to a casing in a wellbore.

5. The laser tool of claim 1, further comprising a shock absorber located at an end of the laser tool and configured to absorb impact to a distal end of the laser tool.

6. The laser tool of claim 1, wherein the mono-optic element comprises a structure comprised of two or more of: a crystal, a lens, a mirror, a prism, a cube, a cylinder, or a cone.

7. A system comprising:

a first laser tool according to claim 1;

a second laser tool according to claim 1; and a motion system to position the first laser tool and the second laser tool within a wellbore.

8. The system of claim 7, wherein the motion system comprises one or more cables that are movable within the wellbore to position the first laser tool and the second laser tool.

9. A method performed within a wellbore of a hydrocarbon-bearing rock formation, the method comprising:

passing, through one or more optical transmission media comprising a fiber-optic cable having a first end and a second end, a laser beam generated by a laser generator attached to the first end of the fiber-optic cable and disposed at an origin of an optical path comprising the one or more optical transmission media;

rotating, about an axis, a laser tool comprising a mono-optic element that is part of the optical path and that has a first end and a second end, the first end of the mono-optic element attached to the second end of the fiber-optic cable such that the mono-optic element receives the laser beam directly from the second end of the fiber-optic cable, the mono-optic element altering at least one of a geometry or a direction of the laser beam for output from the second end of the mono-optic element to the hydrocarbon-bearing rock formation, the mono-optic element comprising at least one of a prism, a cube, and a cone;

monitoring, using one or more sensors, one or more conditions in the wellbore during operation of the laser tool; and outputting signals based on the one or more conditions.

10. The method of claim 9, further comprising rotating the laser tool to target a different area of the hydrocarbon-bearing rock formation.

11. The method of claim 9, further comprising operating the laser generator in a run mode.

12. The method of claim 11, where the run mode comprises a continuous mode, in which the laser generator operates continuously until a target penetration depth is reached.

13. The method of claim 11, where the run mode comprises a cycling mode, where the cycling mode comprises cycling the laser generator between on periods and off periods, where the laser beam is conducted from the laser generator to the focusing system during an on period.

14. The method of claim 9, further comprising the mono-optic element focusing or collimating the laser beam;

sweeping the mono-optic element using a fluid knife;

purging a path of the laser beam using a purging nozzle during the run mode of the laser generator;

sublimating the hydrocarbon-bearing rock formation using the laser beam to create a tunnel to a target penetration depth; and vacuuming dust and vapor using a vacuum nozzle.

15. The method of claim 9, further comprising:

purging a path of the laser beam using a purging nozzle; and vacuuming the dust and vapor using a vacuum nozzle.

16. The method of claim 9, wherein the mono-optic element comprises a structure comprised of two or more of: a crystal, a lens, a mirror, a prism, a cube, a cylinder, or a cone.

17. The method of claim 9, further comprising positioning the laser tool within the wellbore by moving the laser tool uphole or downhole within the wellbore.

* * * * *